US005823358A

United States Patent [19]

Leyden et al.

[11] Patent Number: 5,823,358

[45] Date of Patent: Oct. 20, 1998

[54] SECURITY SYSTEM FOR GARMENT DISPLAY

[75] Inventors: Roger J. Leyden, Willow Springs; Terrance Surma, Bloomingdale, both of Ill.; Christopher Kelsch, Midlothian, Va.

[73] Assignee: Se-Kure Controls, Inc., Franklin Park, Ill.

[21] Appl. No.: 606,923

[22] Filed: Feb. 26, 1996

[51] Int. Cl.[6] ..... E05B 73/00

[52] U.S. Cl. ..... 211/8; 211/4; 211/124; 70/59

[58] Field of Search ..... 211/4, 7, 8, 124, 211/193; 70/58, 59, 62

[56] References Cited

U.S. PATENT DOCUMENTS

| | | | |
|---|---|---|---|
| 3,419,154 | 12/1968 | Shapiro et al. | 211/7 |
| 3,472,385 | 10/1969 | Shapiro et al. | 211/7 |
| 3,537,625 | 11/1970 | Nuttall | 211/124 X |
| 3,659,721 | 5/1972 | Parillo | 211/7 |
| 3,690,130 | 9/1972 | Eutzler | 70/18 |
| 3,735,875 | 5/1973 | Parillo | 211/7 |
| 4,139,102 | 2/1979 | Winton | 211/124 |
| 4,204,601 | 5/1980 | Thomas | 211/4 |
| 4,300,690 | 11/1981 | Thomas | 211/4 |
| 4,336,885 | 6/1982 | Thomas | 211/4 |
| 4,340,145 | 7/1982 | Cameron | 211/7 X |
| 4,753,355 | 6/1988 | Hall et al. | 211/7 X |
| 4,844,257 | 7/1989 | Seynhaeve | 211/124 X |
| 5,160,048 | 11/1992 | Leyden et al. | 211/7 |
| 5,345,219 | 9/1994 | Rogers | 340/568 |

*Primary Examiner*—Leslie A. Braun
*Assistant Examiner*—Kimberly T. Wood
*Attorney, Agent, or Firm*—Wood, Phillips, VanSanten, Clark & Mortimer

[57] ABSTRACT

A security system having a frame with an upwardly facing support surface, a hanger for an article of clothing having a downwardly facing edge that can be placed against the upwardly facing support surface to thereby maintain the hanger in a display position, a cover, and first structure cooperating between the cover and the frame for mounting the cover for movement relative to the frame selectively between a) a first position wherein the hanger can be placed into and removed from the display position and b) a second position wherein the cover closely captively maintains the hanger in the display position.

12 Claims, 2 Drawing Sheets

2/2

SECURITY SYSTEM FOR GARMENT DISPLAY

BACKGROUND OF THE INVENTION

1. Field of the Invention

This invention relates to point of purchase displays for garments and, more particularly, to a security system for preventing unauthorized removal of hangers, upon which the garments are supported, from the display.

2. Background Art

Theft from point of purchase displays remains a vexatious problem in many different industries. This is particularly true in stores in which garments are displayed on racks upon conventional hangers. The most common of these displays used has a horizontally extending bar upon which the individual hangers can be placed. This type of display is convenient from the standpoint that it allows the customer/prospective customer to easily shift the garments along the support bar to access the particular garment that is of interest. That garment, together with the hanger therefor, can then be separated from the display rack to allow the customer/prospective customer to view the full length of the garment and possibly try the garment on.

While the above type of display is desirable from a convenience standpoint, such displays leave the garments dangerously vulnerable to thieves. A thief may grab a garment and associated hanger and flee from the store. In a worst case, the hangers can be slid along the support bar to allow an accumulation of the garments on the hangers to be grasped, removed from the display, and taken unlawfully from the premises.

One proposed system that addresses the above problems is commercially offered by the assignee herein as its "Hanger Lock Box". As shown in U.S. Pat. No. 5,160,048, which covers this system, a trough-shaped, upwardly opening housing has receptacles on spaced, facing walls thereof to receive the hooked upper end of each hanger. With the hangers in place, a hinged cover is closed over the top of the hangers to block the hangers within the receptacles on the housing. The cover can be releasably locked in its closed position.

While this type of security system has proven commercially successful, it has one principal drawback. The hangers are required to be placed where there are receptacles. The receptacles are spaced along the housing at uniform intervals. While this is generally acceptable on most displays, it is sometimes desirable to have a different spacing between the receptacles. For example, if the garments have a different thickness, it may be desirable to have a larger space between hangers to accommodate thicker garments and a narrower space to accommodate thinner garments. In some displays, it is desirable to fit more garments than there are receptacles or to compress the garments at one end of the display. The only way to accommodate the different spacing requirements would be to customize the spacing of the receptacles. However, as each display arrangement may have its own requirements, it is impractical to attempt to make other than a universal-type unit.

SUMMARY OF THE INVENTION

In one form of the invention, a security system is provided having a frame with an upwardly facing support surface, a hanger for an article of clothing having a downwardly facing edge that can be placed against the upwardly facing support surface to thereby maintain the hanger in a display position, a cover, and first structure cooperating between the cover and the frame for mounting the cover for movement relative to the frame selectively between a) a first position wherein the hanger can be placed into and removed from the display position and b) a second position wherein the cover closely captively maintains the hanger in the display position.

The cover may be pivotable about a first axis between the first and second positions. The cover could be translatable or otherwise movable between the first and second positions.

In one form, the frame has an elongate arm defining the upwardly facing support surface and the first axis is transverse to the length of the elongate arm.

The cover may have a concave surface that abuts to the hanger with the hanger in the display position and the cover in the second position.

The support surface may have a convex shape that is complementary to the concave surface of the cover.

Second structure may be provided cooperating between the cover and frame for releasably locking the cover in the second position.

The second structure may include a bore on the frame, with a post on the cover that is extended into the bore, with the second structure in a locked position, and retracted from the bore, with the second structure in an unlocked position.

A compressible material may be provided on at least one of the cover and the support surface so that the hanger is pressed into the compressible material with the hanger in the display position and the cover in the second position.

In one form, there is a compressible material on each of the cover and the support surface, with the hanger being pressed into the compressible material on each of the cover and the support surface with the hanger in the display position and the cover in the second position.

The compressible material can be at least one of gum rubber and open cell neoprene.

In one form, the frame has an upright portion with a base for maintaining the upwardly facing support surface in an elevated position relative to a subjacent surface upon which the base of the frame is supported.

In another form of the invention, a security system is provided for an article hanger, which security system has a frame with an elongate upwardly facing support surface, a cover having a surface, and first structure cooperating between the cover and the frame for mounting the cover for movement relative to the frame between a) a first position wherein the cover surface is spaced substantially from the upwardly facing support surface on the frame and b) a second position wherein the cover surface is closely adjacent to the upwardly facing support surface. A compressible material is provided on at least one of the upwardly facing support surface and cover surface to allow a portion of a garment hanger to be closely captively maintained between the cover and the upwardly facing support surface.

The invention further contemplates this structure in combination with a garment hanger having a hook portion that extends around the upwardly facing support surface with the garment hanger in a display position. The garment hanger is captive compressibly between the cover and the upwardly facing support surface with the garment hanger in a display position and the cover in the second position.

DETAILED DESCRIPTION OF THE DRAWINGS

Figure 1:
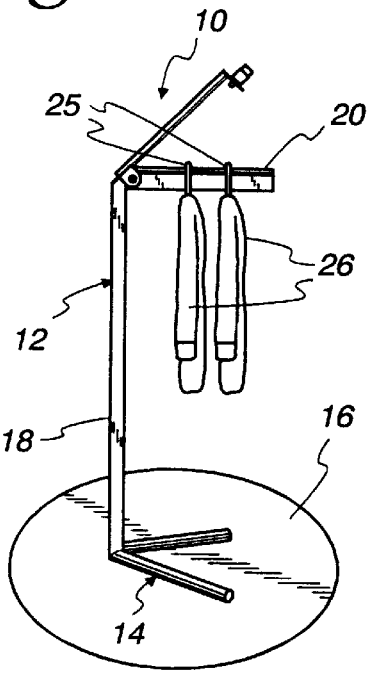
FIG. 1 is a schematic perspective view of a security system, according to the present invention, with a plurality of garments on hangers in a display position thereon, and with a cover thereon in an open position to allow the hangers to be placed on and removed from a support surface on the system.
Figure 2:
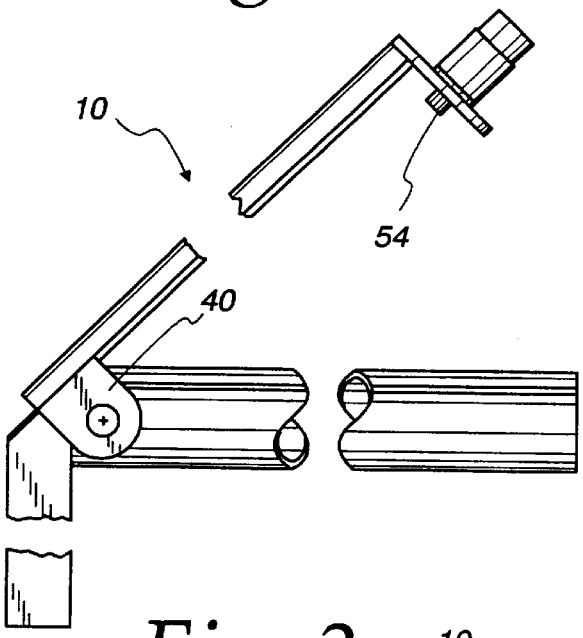
FIG. 2 is a fragmentary, side elevation view of the security system with the cover in the open position.
Figure 4:
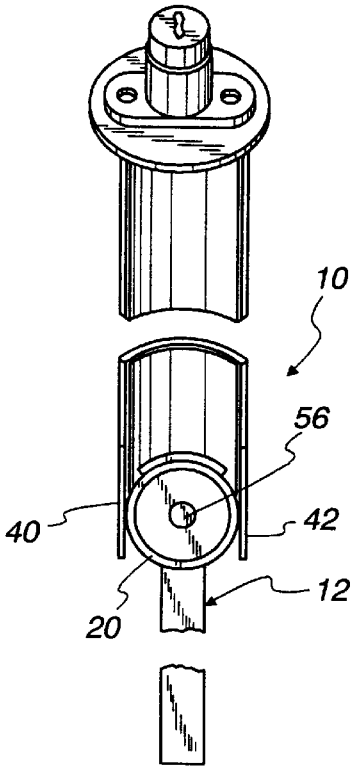
FIG. 4 is a front elevation view of the security system with the cover in the open position.
Figure 3:
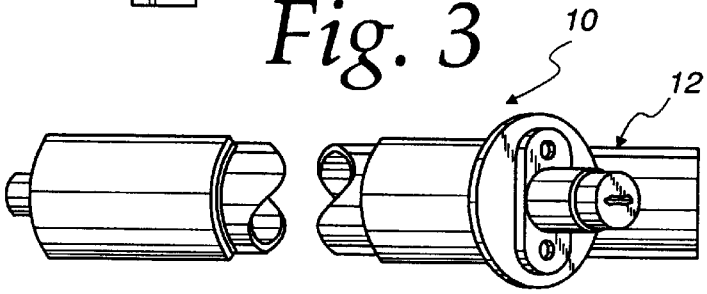
FIG. 3 is a plan view of the security system with the cover in the open position.

In FIGS. 1–8, a preferred form of security system, according to the present invention, is shown at 10. The security system 10 is defined by a frame 12, which has a base 14 for placement against a subjacent support surface 16. The base 14 supports an upright portion 18 of the frame 12. The top of the upright portion 18 has an elongate arm 20 projecting in cantilevered fashion therefrom.

The arm 20 is defined by a piece of tubing having a circular cross section and a convex outer surface 22, with a portion thereof facing upwardly and defining a support for individual hangers 25 that carry garments 26 in conventional fashion. The upper part of the outer surface 22 is covered by a thin layer 27 of gum rubber. With the hangers 25 in the display position of FIGS. 1 and 5, a concave edge 28 on a hook portion 30 of the hanger 25 surrounds the complementarily-shaped outer surface 22 and bears downwardly on, and presses into, the upwardly facing, outer surface 32 of the layer 27. The hook portion 30 is defined by a formed elongate body having a diameter D (FIG. 8) in cross section taken transversely to the length of the elongate body.

An elongate cover 36 is pivotably connected to the arm 20 through a pin 38. The pin 38 extends through spaced, depending ears 40, 42 on the cover 36, which straddle the arm 20. The pin 38 guides pivoting movement of the cover 36 about an axis 44 between an open position, shown in FIGS. 1–5, and a closed position, shown in FIG. 6. The axis 44 extends transversely to the length of the elongate arm 20 and cover 36.

In the open position, hangers 25 can be selectively placed in the display position along the length of the arm 20, slid along the length of the arm 20, and removed from the display position without interference from the cover 36.

Once the desired number of hangers 25 is placed in the display position, the cover 36 is closed. As seen more clearly in FIG. 7, the cover 36 has a curved cross-sectional configuration with a concave surface 46 facing downwardly and conforming to the curvature of the peripheral surface 22 of the elongate arm 20. A compressible layer 48 is adhered to the cover surface 46. Preferably, the layer 48 is made from open cell neoprene.

By pivoting the cover 36 downwardly to the closed position, the hook part 30 of the hanger 25 squeezes into the compressible layers 48, 27 on the cover 36 and arm 20. The hanger 25 is thereby effectively locked against shifting lengthwise of the arm 20 and cover 36. Consequently, regardless of what location the hanger 25 is placed at along the length of the arm 20, it will be positively locked in place when the cover 36 is closed. The frictional forces generated between the hanger 25 and the layers 48, 27 also inhibits pivoting of the hanger 25 around the lengthwise axis of the arm 20 as might be attempted by a thief to release the hanger 25 from the arm 20.

A lock assembly at 50 releasably maintains the cover 36 in a closed position. The lock assembly 50 includes a conventional-type mechanism 52 that is operated through a key 54 to selectively extend and retract a plunger element/post 54. In the locked state, the plunger element 54 projects into a bore 56 in an end wall 58 at the free end of the arm 20. In the extended position, the plunger 53 prohibits pivoting of the closed cover 36 to the open position therefor.

With the inventive structure, the hangers 25 can be located anywhere along the length of the arm 20. Spacing between the hangers 25 can be conveniently selected depending upon the thickness of the associated garments 26.

Figure 9:
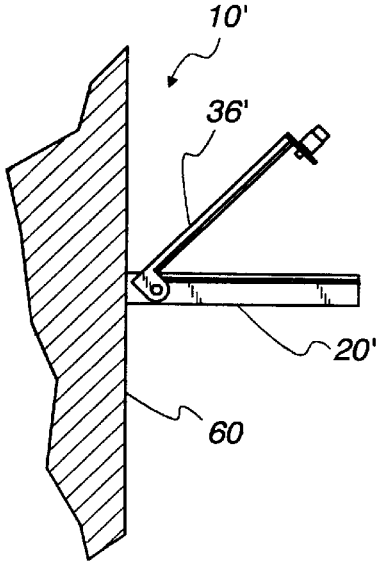
FIG. 9 is a schematic, side elevation of a modified form of security system, according the present invention.
Figure 6:
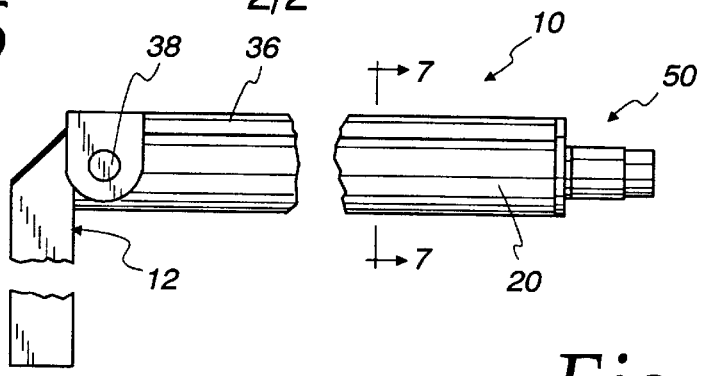
FIG. 6 is a view as in FIGS. 2 and 5 with the cover in a closed position.
Figure 7:
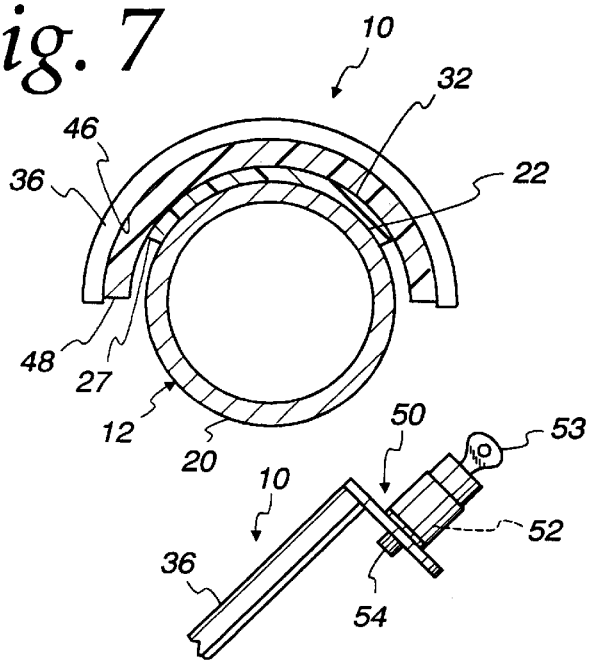
FIG. 7 is an enlarged, cross-sectional view of the security system taken along line 7—7 of FIG. 6.
Figure 8:
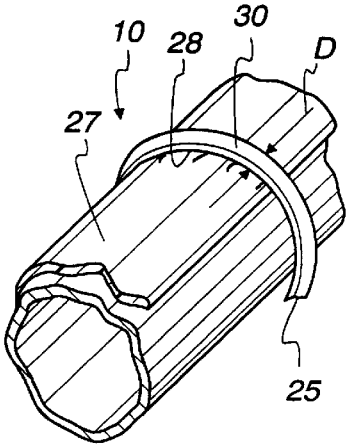
FIG. 8 is an enlarged, fragmentary, perspective view of a hanger squeezed into the support surface therefor with the cover in the closed position.
Figure 5:
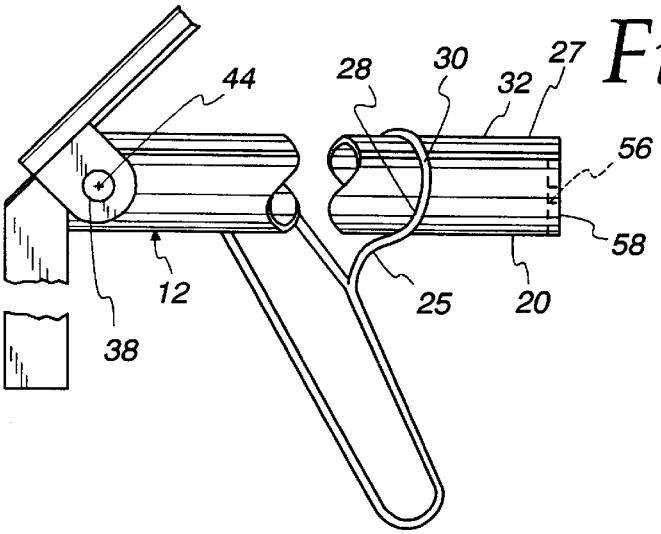
FIG. 5 is a view as in FIG. 2 with a hanger in the display position on the support surface.

In FIG. 9, a modified form of security system, according to the present invention, is shown at 10'. The system 10' is similar to that at 10 in that it has an elongate arm 20' and a pivotable cover 36', corresponding to the support arm 20 and cover 36 in the previously described embodiment. The principal difference in the system 10' is that the arm 20' is supported from a vertical wall 60 in cantilever fashion. This obviates the need for the more elaborate supporting frame 12, as shown in FIG. 1.

The foregoing disclosure of specific embodiments is intended to be illustrative of the broad concepts comprehended by the invention.

We claim:

1. A security system comprising:

a frame having an elongate arm having a length and defining an upwardly facing support surface;

a hanger for an article of clothing having a hook defined by a formed elongate body, the body having a diameter taken in cross section transversely to the length of the body and defining a downwardly facing edge that can be placed against the upwardly facing support surface to thereby maintain the hanger in a display position;

a cover mounted to the frame for movement relative to the frame selectively between a) a first position wherein the hanger can be placed into and removed from the display position and b) a second position wherein the cover closely captively maintains the hanger in the display position, there further being a compressible material on at least one of the cover and the frame, the hook being squeezed between the frame and cover so as to be pressed into the compressible material with the hanger in the display position and the cover in the second position to produce frictional holding forces between the hook and the compressible material, the compressible material having a thickness between the frame and cover that is not substantially greater than the diameter of the formed elongate body, whereby the frictional forces generated between the hanger and the compressible material layer inhibit pivoting of the hanger around the length of the elongate arm with the hanger in the display position and the cover in the second position to thereby avoid release of the hanger from the display position.

2. The security system according to claim 1 wherein the cover is pivotable about a first axis between the first and second positions.

3. The security system according to claim 1 wherein the first axis is transverse to the length of the elongate arm.

4. The security system according to claim 1 wherein the cover has a concave surface that exerts a holding force on the hanger with the hanger in the display position and the cover in the second position.

5. The security system according to claim 4 wherein the support surface is convex and the concave surface of the cover conforms to the convex support surface over a substantial portion thereof on which the hook on the hanger can be placed in the display position so that the hook on the hanger is positively captively held between the frame and the cover.

6. The security system according to claim 1 including a lock for releasably locking the cover in the second position.

7. The security system according to claim 1 wherein compressible material is on each of the cover and the frame and the hanger is pressed into the compressible material on each of the cover and the frame with the hanger in the display position and the cover in the second position.

8. The security system according to claim 6 wherein the lock is key operated and comprises a bore in the frame and a post on the cover that is extendable into the bore in the frame with the lock in a locked position and retracted from the bore in the frame with the lock in an unlocked position, the post being extendable between the locked and unlocked positions for the post in a line that is substantially parallel to the length of the elongate arm.

9. The security system according to claim 1 wherein the frame comprises an upright portion with a base for maintaining the upwardly facing support surface in an elevated position relative to a subjacent surface upon which the base of the frame is supported.

10. The security system according to claim 1 wherein the compressible material comprises at least one of gum rubber and open cell neoprene.

11. The security system according to claim 1 wherein the frame has an elongate arm projecting in cantilever fashion and defining the upwardly facing support surface.

12. The security system according to claim 1 wherein the frame comprises an upright portion with a base for maintaining the upwardly facing support surface in an elevated position relative to a subjacent surface upon which the base of the frame is supported.

* * * * *